US005795267A

United States Patent [19]

Weaver

[11] Patent Number: 5,795,267

[45] Date of Patent: Aug. 18, 1998

[54] PRE-TENSIONED FLOOR SYSTEM

[75] Inventor: Darrell A. Weaver, Sedalia, Mo.

[73] Assignee: PlaySmart, Inc., Sedalia, Mo.

[21] Appl. No.: 505,011

[22] Filed: Jul. 21, 1995

[51] Int. Cl.[6] ..... A63B 9/00

[52] U.S. Cl. ..... 482/35; 482/23; 52/664

[58] Field of Search ..... 482/23, 26, 27, 482/28, 29, 35, 77, 142, 36; 52/222, 223.1, 223.6, 664; 38/102.3, 102.5; 5/211, 191; 182/139

[56] References Cited

U.S. PATENT DOCUMENTS

| | | | |
|---|---|---|---|
| Re. 24,978 | 5/1961 | Bottoms et al. . | |
| 1,783,835 | 12/1930 | Fenton et al. | 38/102.5 |
| 1,987,921 | 1/1935 | Bertsch | 5/191 |
| 2,377,928 | 6/1945 | Fielitz et al. . | |
| 2,728,941 | 1/1956 | Alles et al. . | |
| 2,916,746 | 12/1959 | Pease | 182/139 |
| 3,008,711 | 11/1961 | Dillon | 482/36 |
| 3,077,149 | 2/1963 | Eckel | 182/139 |
| 3,643,942 | 2/1972 | Williams . | |
| 3,730,520 | 5/1973 | Willis . | |
| 3,734,496 | 5/1973 | Rubin . | |
| 3,767,192 | 10/1973 | Eriksson . | |
| 3,814,416 | 6/1974 | Munger et al. . | |
| 3,839,820 | 10/1974 | Serman, Jr. . | |
| 3,840,226 | 10/1974 | Sharp . | |
| 3,896,573 | 7/1975 | Gibby | 38/102.5 |
| 3,950,908 | 4/1976 | Van Eyk . | |
| 4,045,021 | 8/1977 | Nissen . | |
| 4,162,063 | 7/1979 | Nissen et al. | 482/27 |
| 4,177,991 | 12/1979 | Meyer et al. . | |
| 4,199,136 | 4/1980 | Mansfield . | |
| 4,244,567 | 1/1981 | Linzee et al. . | |
| 4,270,308 | 6/1981 | Mitsuishi et al. . | |
| 4,270,748 | 6/1981 | Ray . | |
| 4,348,188 | 9/1982 | Ahrens . | |
| 4,489,941 | 12/1984 | Shieh | 482/28 |
| 4,603,853 | 8/1986 | Satterthwaite . | |
| 4,943,046 | 7/1990 | Beltzig . | |
| 4,971,742 | 11/1990 | Brooks et al. . | |
| 4,978,120 | 12/1990 | Greenwood . | |
| 5,022,702 | 6/1991 | Straub et al. . | |
| 5,167,595 | 12/1992 | Gleeson et al. | 482/35 |
| 5,177,926 | 1/1993 | Frankel | 482/35 |
| 5,226,864 | 7/1993 | Showers . | |
| 5,230,186 | 7/1993 | Hammonds et al. . | |
| 5,299,989 | 4/1994 | Boyd et al. | 482/27 |
| 5,330,400 | 7/1994 | Huberman | 482/35 |
| 5,356,354 | 10/1994 | Owens | 482/35 |
| 5,404,683 | 4/1995 | Hammonds et al. . | |
| 5,405,304 | 4/1995 | Petersheim et al. | 482/35 |

FOREIGN PATENT DOCUMENTS

| | | | |
|---|---|---|---|
| 724244 | 2/1955 | United Kingdom | 482/27 |

OTHER PUBLICATIONS

Reid, J. David, et al., Laboratory Device For Stretching Cloth in Two Directions, American Dyestuff Reporter, May 25, 1964, pp. 29–33.

*Primary Examiner*—Richard J. Apley
*Assistant Examiner*—Victor K. Hwang
*Attorney, Agent, or Firm*—Bryan Cave LLP

[57] ABSTRACT

A play system floor includes a frame defining the periphery of an area to be floored and a webbed flooring constructed of a webbing material extending between the frame members. The webbing material has an optimal predetermined stretch coefficient at which it retains its resiliency, while resisting sagging. The webbed flooring is sized using the stretch coefficient whereby the dimensions of the webbed flooring when stretched substantially correspond to the dimensions of the area to be floored. The webbed flooring is stretched to the dimensions of the area to be floored and secured to the frame. The webbing material is 2" wide nylon webbing spaced 2" apart. The webs that make up the floor are weaved together and sewed together at areas where they overlap. The floor is stretched to the dimensions of the area to be floored by positioning a bar through loops on each side of the weaved flooring, and applying tension to each bar. The webbed flooring is secured to the frame by attaching each bar to the frame using clamps, bands, or other attaching devices. Tension to each bar is applied by operating a screw-actuated clamping member to tighten the bar against the frame.

16 Claims, 8 Drawing Sheets

PRE-TENSIONED FLOOR SYSTEM

BACKGROUND OF THE INVENTION

1. Field of the Invention

The present invention relates generally to flooring for play systems, and more particularly to a webbed floor for a play system in which the webbing is pre-tensioned and weaved.

2. Description of the Prior Art

Play systems for children are well-known in the art and have evolved into a major industry in the United States. A typical play system, such as shown in FIG. 1, is constructed of a tubular metal frame 2 and may include, for example, one or more enclosed or unenclosed slides 4, platforms 6 at different heights, enclosed or unenclosed passageways 8, a ball bin 10 (balls not shown), monkey bars, trolleys, and other recreational elements suitable for use by children.

The flooring for a play system must generally meet two criteria; it must be resilient so that children may play without injuring themselves, and it must be able to endure prolonged abuse by thousands of children. The simplest type of flooring for a play system is constructed of vinyl or other durable material that is attached to the framing members, generally by forming a loop at the end of the flooring and sliding the framing members through the material. These types of floors suffer from two shortcomings. First, these materials tend to stretch and sag over time, thereby requiring replacement of the flooring or possible loss of enjoyment of the play system by children. Second, since the vinyl or other material is opaque, parents who are concerned about their children's safety on the upper platforms of the play system may lose sight of their children.

In an attempt to overcome these shortcomings, layered web floors, such as shown in FIG. 2, were developed. Such a floor consists of straps of webbing, 14 and 16, made of nylon or other material, which are oriented perpendicular to each other. At their ends, the web straps are wrapped around the frame members 12 to form a loop and are then sewed to themselves. In this type of webbed flooring, all of the straps that are oriented in one direction, e.g. straps 14, are located either above or below all of the straps oriented in the other direction, e.g. straps 16. Where the straps 14 and 16 pass over each other, they are sewed together.

This type of webbed flooring suffers from several shortcomings as well. First, when a child is standing on a single web strap on the lower layer of straps, the stitching that attaches the web strap to the upper layer of straps will bear much of the weight of the child. Consequently, the stitching in this type of floor tends to tear over time, resulting in separation of the layers of the floor and requiring replacement of the floor. Second, this type of floor also tends to stretch out over time, thereby requiring relatively frequent replacement.

In this type of flooring system, an alternative method of attaching the webs to the frame may be used. Each web may include a loop at each end formed by sewing the web to itself. The webbing is made to alternate between straps that are shorter, having a length extending approximately the length between opposed frame members, and longer length webs, sized so that the loops at the ends of the longer webs pass around the frame members and align with the loops at the ends of the shorter straps. A relatively rigid rod is then passed through the aligned loops of the shorter and longer webs. The webs passing around the frame secure the floor to the frame. These types of floors are difficult to assemble, and tend to sag due to the difficulty in tensioning the floor as a result of the difficult assembly procedure.

In order to reduce the tendency of play system floors to sag, the floor may be tensioned. One known method of tensioning the floor is to attach springs to the floor. This type of system is used, for example, in tensioning trampoline floors. Use of such a tensioning system is not desirable because the springs are expensive and remain exposed so as to endanger children on the play system.

Another type of tensioning system, as shown in FIGS. 3 and 4, is to attach one loop of a tensioning harness 18 to a rod 20 running around the perimeter of the floor through loops in the flooring material. The other loop of the harness is attached to the frame around the base of the floor. A threaded rod on the harness is used to tension the floor. In either of these methods, i.e., using springs or a tensioning harness, the tensioning device becomes a permanent component of the floor, thereby making such floors more expensive.

One object of the present invention is to provide a play system floor that is durable and is pre-tensioned so as to be resistant to sagging. Another object of the present invention is to provide a play system floor in which the tensioning device does not become a permanent part of the floor.

SUMMARY OF THE INVENTION

The present invention is a play system floor which includes a frame defining the periphery of a floor and a webbed floor constructed of a webbing material extending between the frame members. The webbing material has an optimal predetermined stretch coefficient at which it retains its resiliency, while resisting sagging. The webbed flooring is sized using the stretch coefficient whereby the dimensions of the webbed flooring when stretched substantially correspond to the dimensions of the area to be floored. The webbed flooring is stretched to the dimensions of the area to be floored and secured to the frame.

The webbing material is preferably 2" wide nylon webbing. In order to increase the durability of the floor, the webs that make up the flooring are weaved and sewn together at areas where the webs overlap.

The step of stretching the webbed flooring to the dimensions of the area to be floored preferably includes positioning a relatively rigid bar through loops on each side of the webbing material, and applying tension to each relatively rigid bar for stretching the webbed flooring to the dimensions of the frame. The step of securing the webbed flooring to the frame preferably comprises attaching each rigid bar to the frame in fixed relation thereto using clamps, bands, or other securing means. Tension to each rigid bar is applied by operating a screw-actuated clamping member to tighten the bar against the frame.

DESCRIPTION OF THE PREFERRED EMBODIMENT

Figure 1:
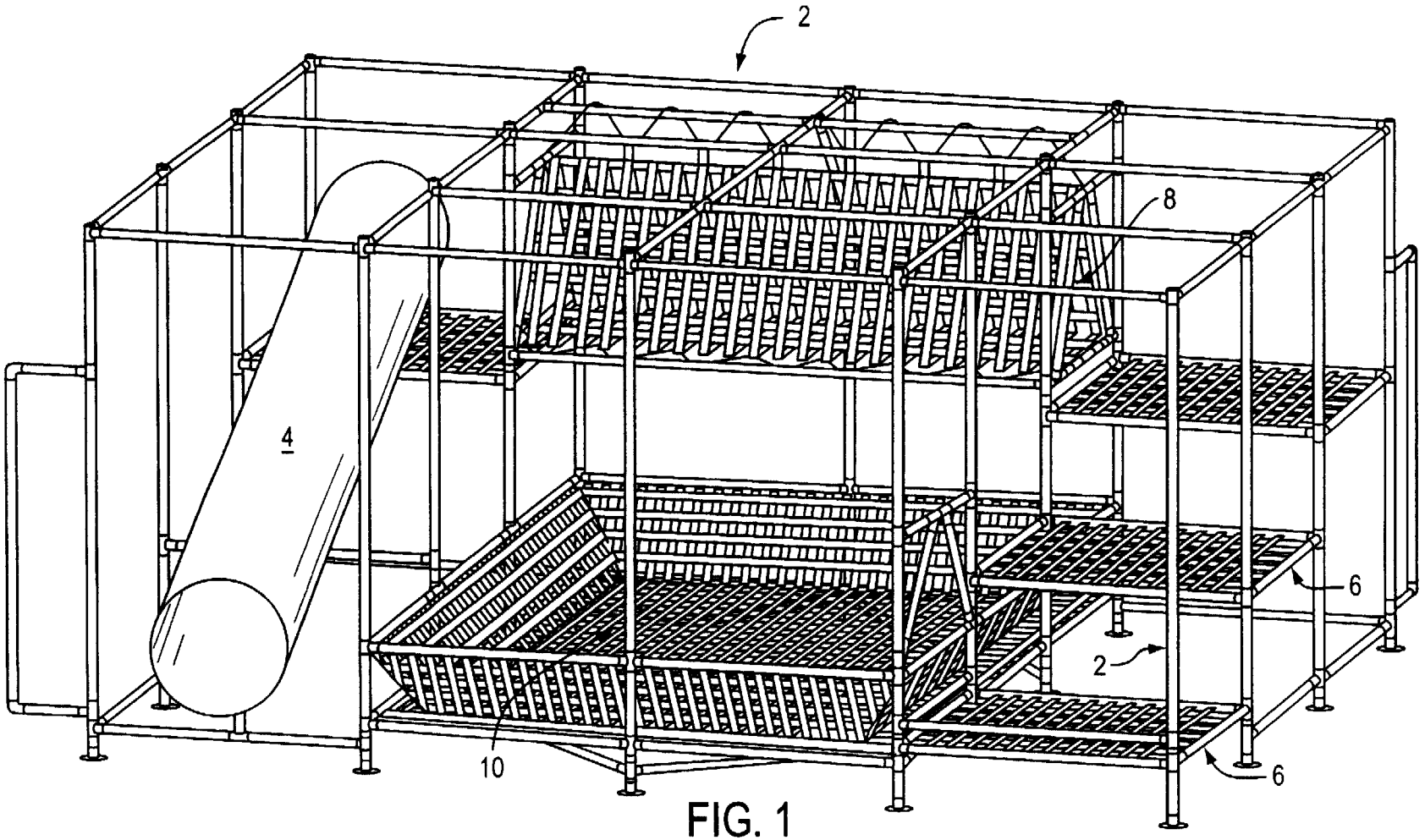
FIG. 1 (PRIOR ART)
FIG. 1 is a perspective view of a typical play system.
Figure 5:
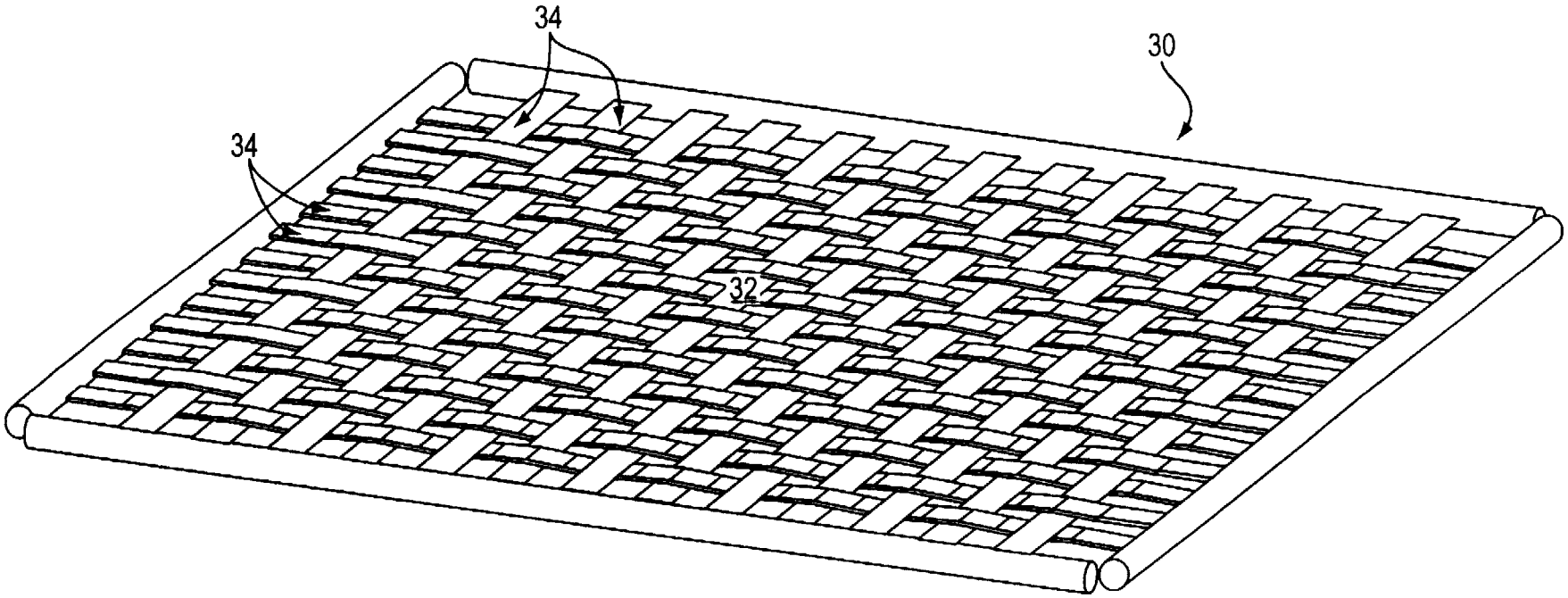
FIG. 5 shows a woven play system floor in accordance with the present invention.

FIG. 5 shows a play system floor in accordance with the present invention. The play system floor includes frame members 30 (corner connectors not shown) that extend around the periphery of the floor of a play system, such as that shown in FIG. 1. In a preferred embodiment, frame members 30 are preferably constructed of Allied Tubing & Conduit brand 10 gauge 1.66" OD recreational structural tubing. Frame members 30 do not themselves form part of the present invention, and it is foreseen that the present invention is applicable for use with any appropriate type of frame member.

Formed within the frame 30 is a floor 32 that is constructed of flexible webbing, preferably National Webbing brand 2" wide nylon webbing (Herringbone Style—No. 002), that is woven as shown so that each web alternately passes above then below the webbing oriented perpendicular thereto. The webs are preferably separated by 2" so that it is possible to see through the floor. It is foreseen that any type of appropriate webbing, including those having other weave patterns and those made of other materials, including polyester, may be used in lieu of the preferred webbing.

Figure 2:
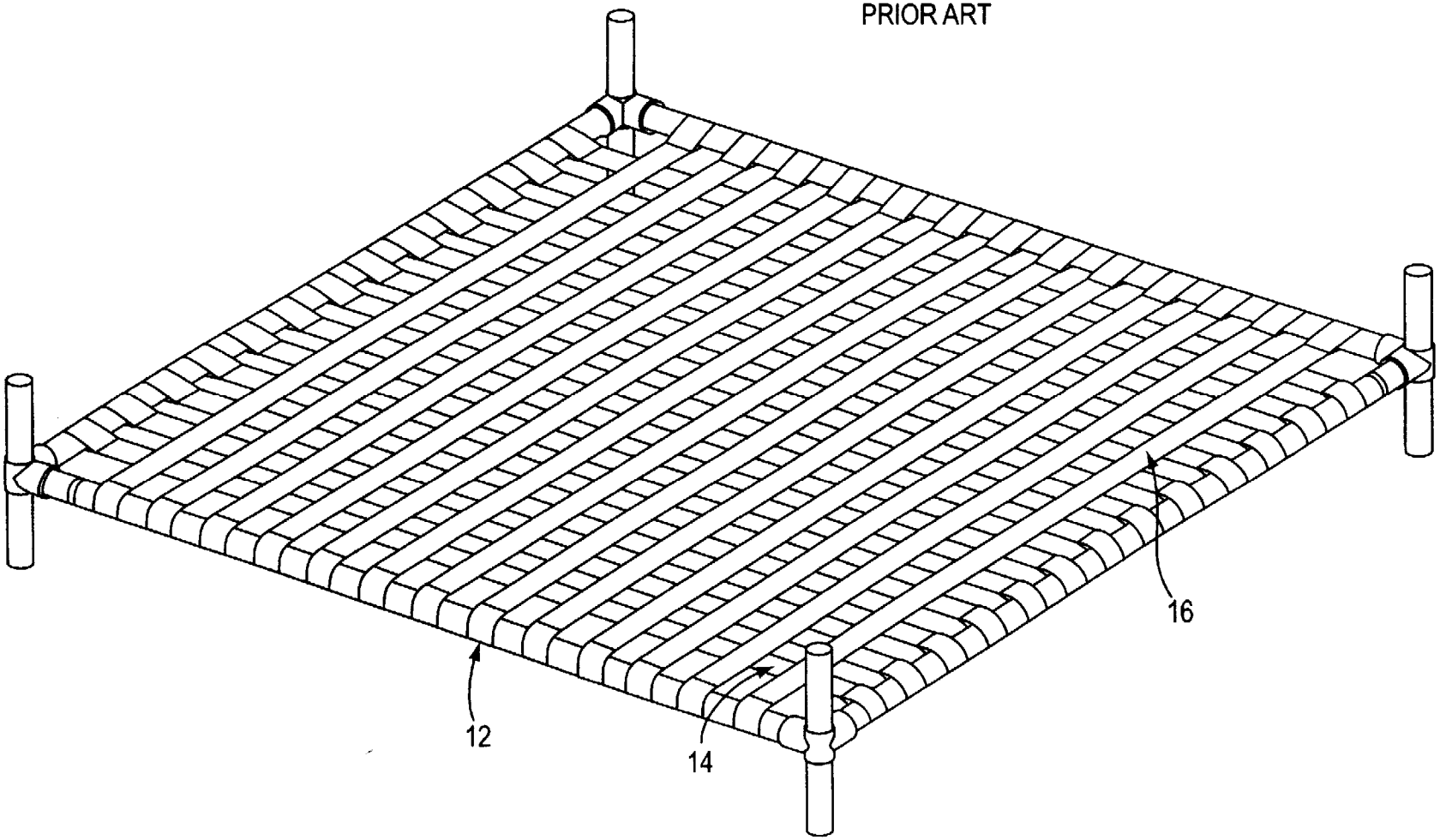
FIG. 2 PRIOR ART
FIG. 2 is a perspective view of a prior art play system floor which is constructed of layered webbing.
Figure 3:
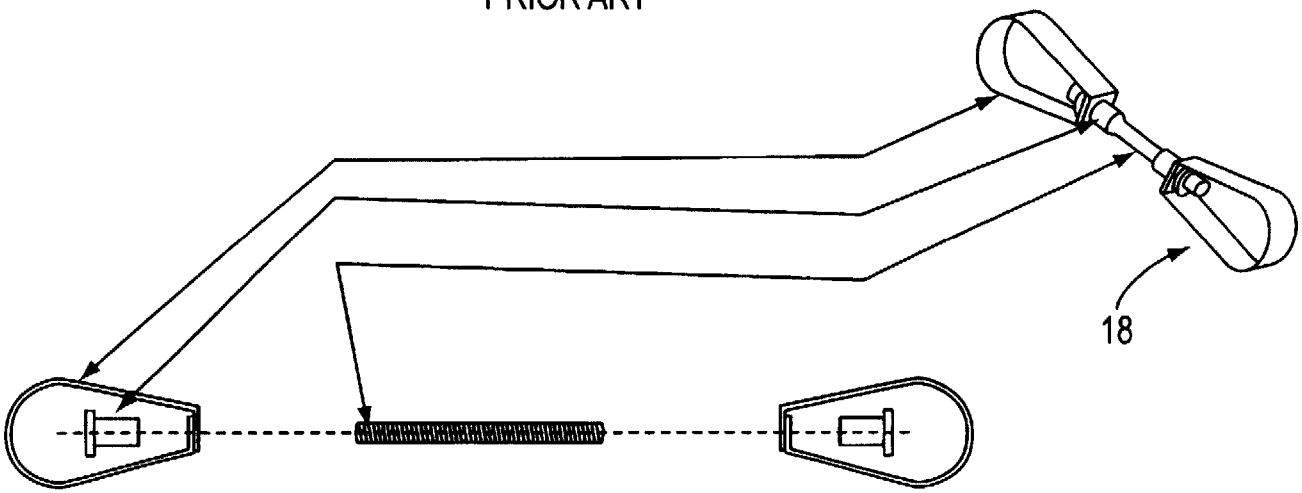
FIG. 3 PRIOR ART
FIG. 3 is a perspective view and an exploded view of a prior art floor tension harness.
Figure 4:
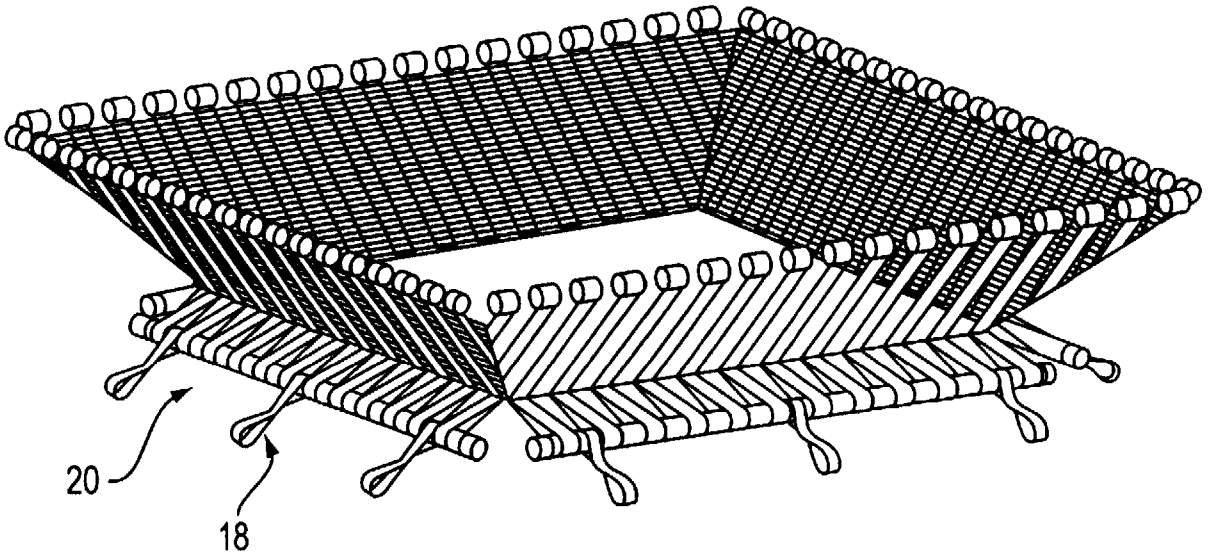
FIG. 4 PRIOR ART
FIG. 4 is a perspective view of a prior art system for tensioning the floor of a play system.
Figure 7:
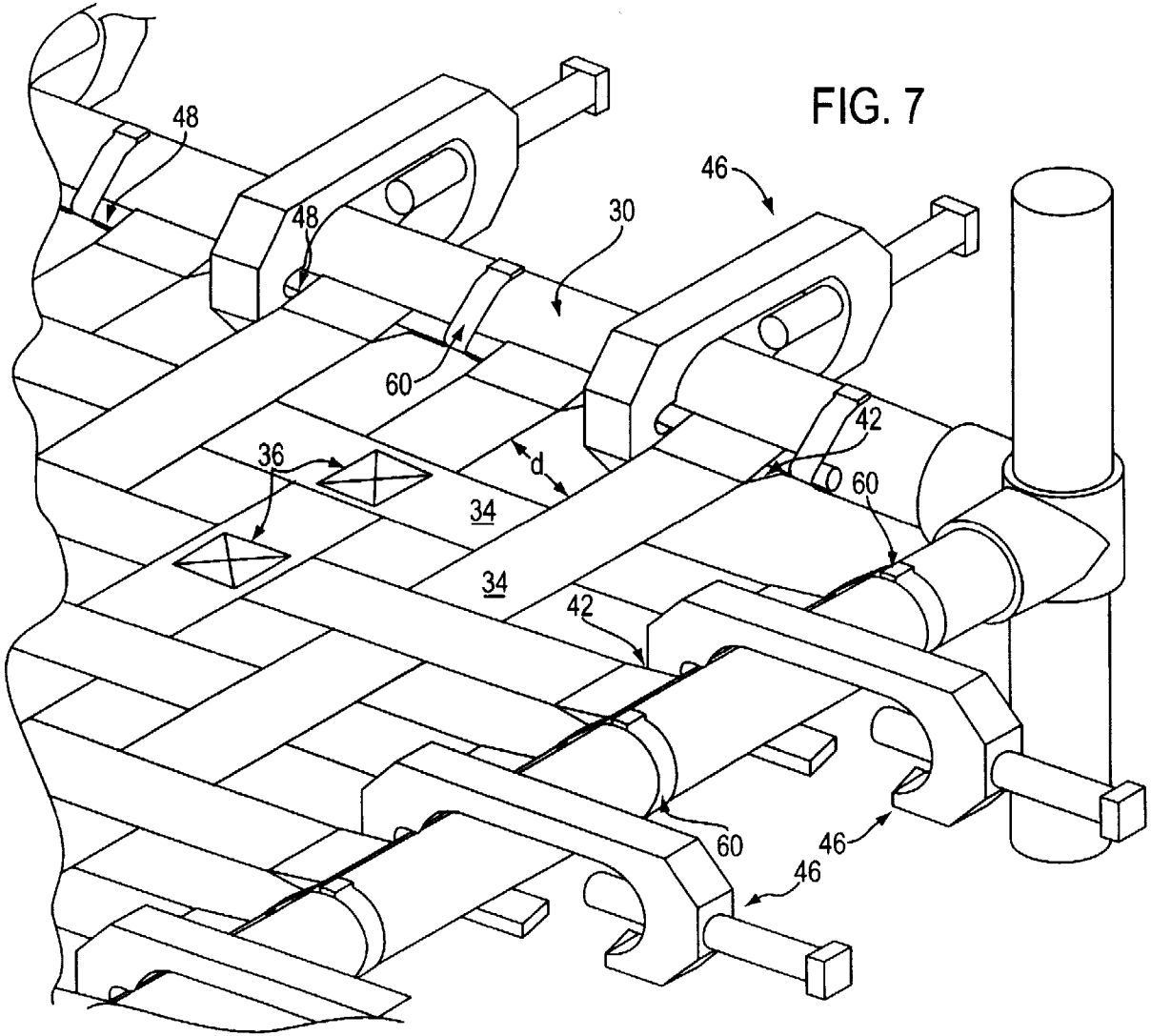
FIG. 7 is an enlarged perspective view showing the play system floor tensioning system of the present invention.

As shown in detail in FIG. 7, at the intersections at which the straps cross one another, the straps are attached to each other by means of conventional stitching 36, preferably using a box and cross stitch. The stitching 36 is preferably in a square pattern having an open "X" pattern therein as shown. It will be appreciated that straps 34 may be attached to each other by any type of stitching or any conventional fastening means. Because the floor 32 is woven, even if the stitching 36 were to tear, the floor 32 would retain its structural integrity due to the interlocking nature of the weave pattern and the tension that is put on the web strap. In contrast, in prior art non-weaved floors such as shown in FIG. 2, when the stitching tears, the floor will tend to separate. It will be appreciated that the weaved floor of the present invention will function effectively without stitching 36.

Figure 6:
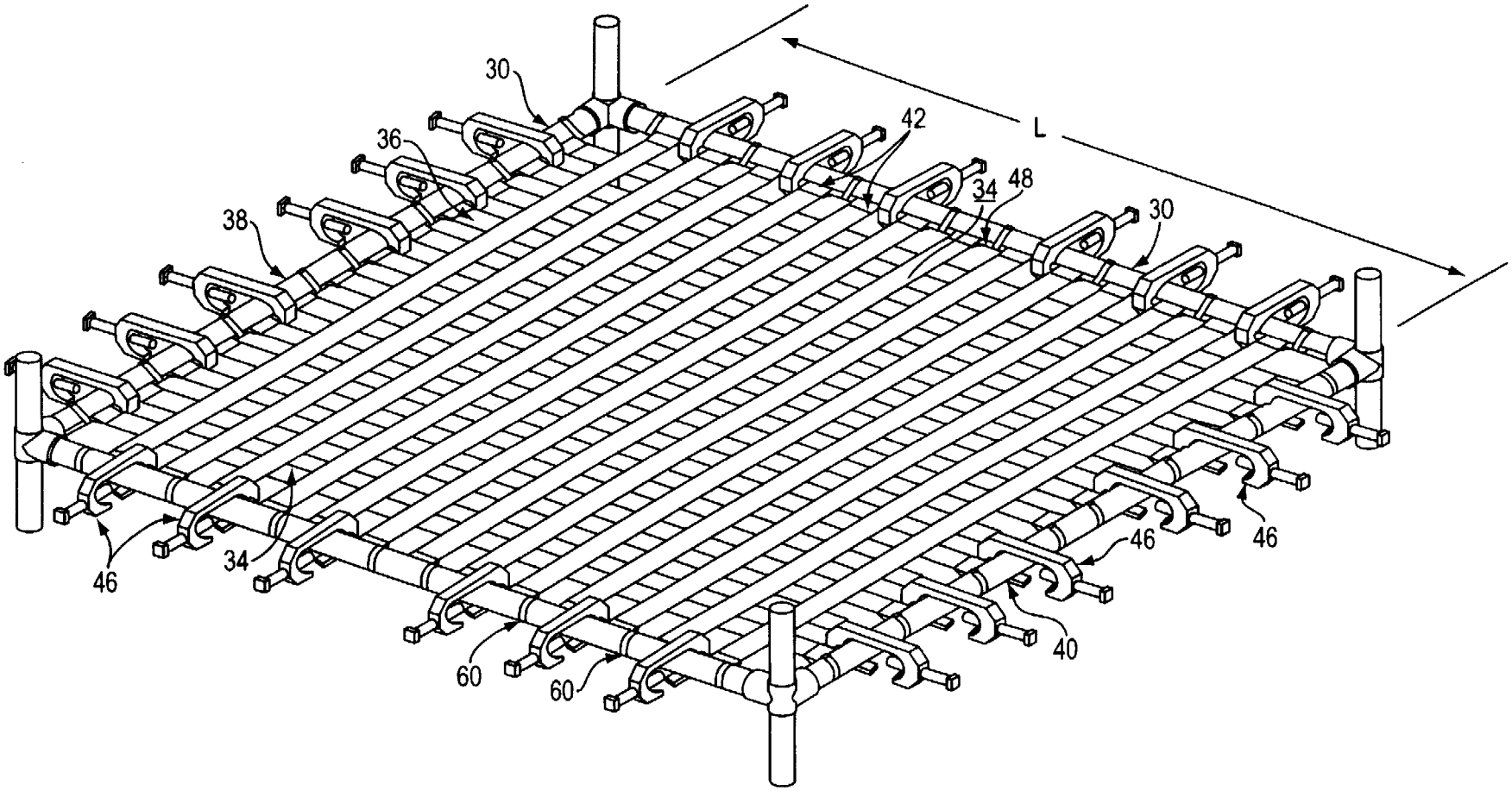
FIG. 6 PRIOR ART
FIG. 6 is a perspective view showing the play system floor tensioning system of the present invention.

As previously discussed and as shown in FIG. 7, web members 34 are preferably 2 inch wide nylon strips, with a 2 inch gap "d" extending between adjacent webs 34. Weaved floor 32 is installed in frame 30 under an amount of tension that will not damage the nylon webbing but that stretches the nylon webbing a sufficient amount so that it will retain its tension even under prolonged use. In order that the webbing 34, when tensioned, will properly fit within the dimensions of frame 30, the individual web members are sized shorter than the dimensions of the frame 30. For example, as shown in FIG. 6, if an individual web member 36 is to be attached between opposed frame members 38 and 40 having an inside dimension length "L" between them, web member 36 is made slightly shorter than the length "L" by a predetermined amount based upon the optimal tension for web member 36.

For the preferred webbing, the webbing is preferably stretched 0.00885 inches per inch to achieve the desired degree of tension. Thus, for example, if it is desired to have an installed strap length of 58.25 inches, i.e., the length "L" is 58.25 inches, then each web strap must be made 57.74 inches (58.25−(58.25×0.00885) in order to have the proper amount of tension on the strap when it is installed between frame members that are 58.25 inches apart. The preferred tension for different straps or straps made of other materials may be the amount of tension required to cause a slight deflection in the 13 gauge 1.66" OD frame members. Alternatively, a tension that will not damage the webbing material but that stretches the webbing a sufficient amount so that it will retain its tension under prolonged use may be determined by testing.

Each web member 34 preferably includes a loop 42 at each end thereof. Each loop 42 is formed by folding web 34 on to itself, and then sewing the folded-over portion to the web. In order to install the net within the frame, a relatively rigid rod 48, preferably constructed of solid, cold-rolled steel, is inserted through the loops at the ends of each web strap 34, as shown in FIGS. 6 and 7. As shown in FIG. 6, the tensioning system of the invention is applicable to a floor in which the straps are not weaved. Rod 48 is preferably 55.125 inches long for a frame having a length "L" of 58.25 inches.

Figure 8:
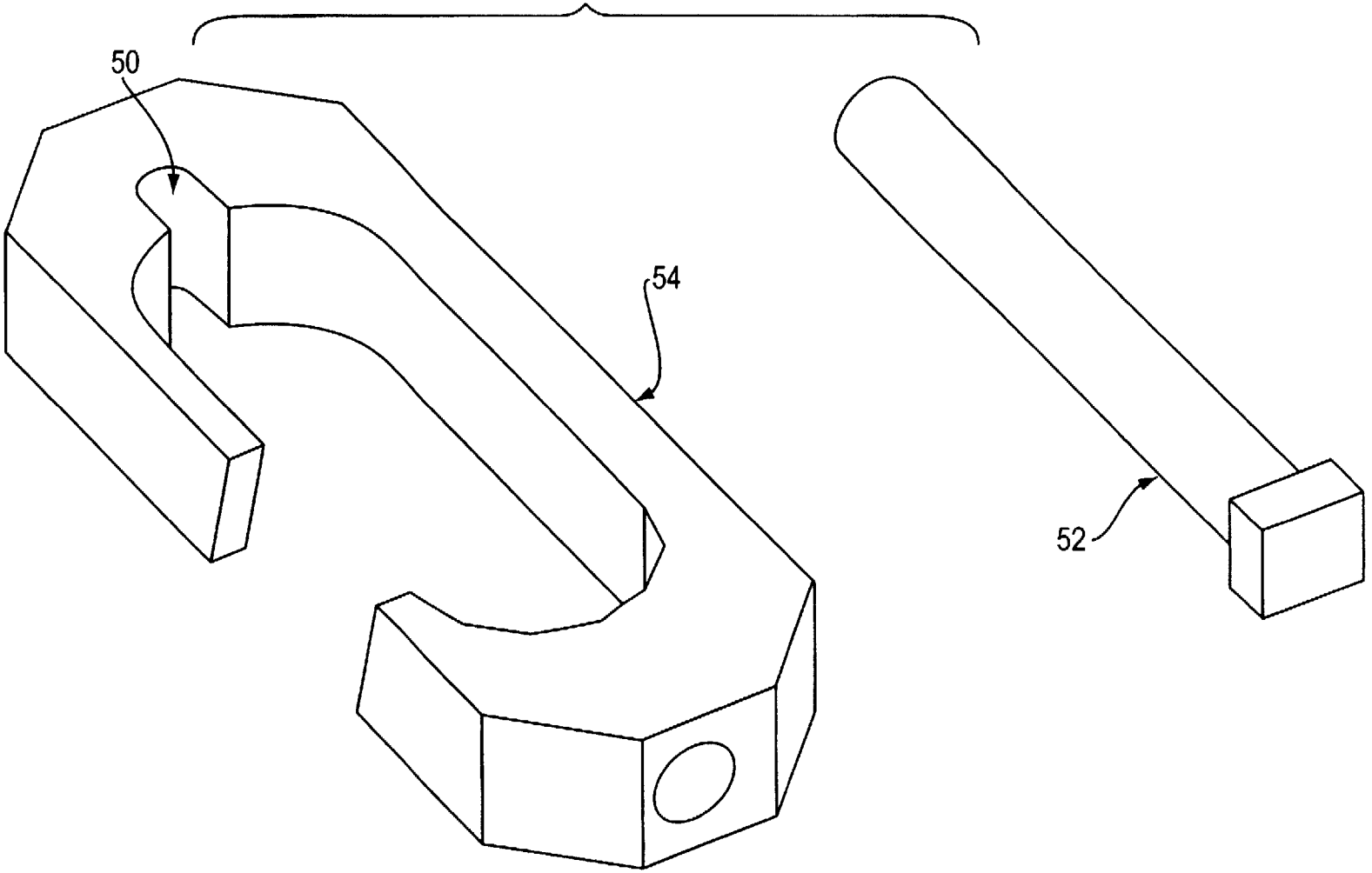
FIG. 8 shows a tensioning bracket in accordance with the present invention.

Net stretch brackets 46 are attached around and engage with frame members 30 and also engage with rods 48 that fit within cutaway 50, as shown in FIGS. 7 and 8. Each bracket 46 includes a threaded set screw 52 (threading not shown) which is screwed down through a clamp member 54. Clamp members 54 preferably measure approximately 7¼" long× 2⅜" high×1" wide. Once rod 48 is inserted into cutaways 50, the threaded set screws 52 are tightened down to pull rods 48 against frame members 30. A number of brackets 46 may be used to tension each side of the floor (FIG. 6). Threaded set screws 52 are preferably systematically screwed down to achieve even positioning of the net within the frame 30. When all of the threaded bolts 52 are screwed down so that rods 48 are pressed firmly against frame 30, the webbed floor 32 is at the proper tension. Finally, clamps or bands 60 are attached around the frame 30 and rods 48 to secure the rods to the frame with the play system floor under the desired tension. Any appropriate clamp 60 may be utilized, such as those manufactured by BAND-IT-IDEX, Inc. ™.

Although the present invention has been described in detail with respect to certain embodiments and examples, variations and modifications exist which are within the scope of the present invention as defined in the following claims.

I claim:

1. A play system floor which comprises:

a rigid frame defining the periphery of an area to be floored, the area to be floored having dimensions;

a webbed flooring comprising a webbing material having a predetermined stretch coefficient, the webbing material having ends along an outer periphery of the webbed flooring, the webbed flooring sized using the stretch coefficient; and at least one rigid rod secured in fixed relation to the ends of the webbing material and secured to the frame also in fixed relation thereto;

whereby the dimensions of the webbed flooring when stretched substantially correspond to the dimensions of the area to be floored, the webbed flooring being stretched to the dimensions of the area to be floored.

2. The play system floor according to claim 1 wherein the webbing material is nylon webbing.

3. The play system floor according to claim 1 wherein the webbed flooring comprises weaved webbing.

4. The play system floor according to claim 3 wherein the weaved webbing is sewed together at areas of overlapping webbing.

5. The play system floor according to claim 1 wherein:

the frame comprises a plurality of sides;

the webbed flooring comprises a plurality of sides corresponding to the sides of the frame and further comprises loops at ends of the webbing material; the play system floor further comprising a rigid bar extending through the loops on each side of the webbed flooring, and securing means for securing each bar to the frame in fixed relation thereto.

6. The play system floor according to claim 5 wherein the securing means comprises brackets attaching the frame to each bar in fixed relation.

7. The play system floor according to claim 5 wherein the floor is stretched by operating a screw-actuated clamping member.

8. The play system floor according to claim 5 wherein the securing means comprises bands attaching the frame to each bar in fixed relation.

9. A play system floor which comprises:

a rigid frame defining the periphery of an area to be floored;

a webbed flooring comprising a webbing material having ends along an outer periphery of the webbed flooring;

at least one rigid rod secured in fixed relation to the ends of the webbing material, tension being applied to the at least one rigid rod for tensioning the webbed flooring; and fixed relation securing means securing the at least one rigid rod to the frame in fixed relation thereto while the tension is applied to the webbed flooring.

10. A method of assembling a play system floor in a rigid frame defining the periphery of an area to be floored, the area to be floored having dimensions the method comprising the steps of:

determining a stretch coefficient for a webbing material from which the floor is to be constructed;

assembling a webbed floor constructed of the webbing material, the webbed flooring sized using the stretch coefficient whereby the dimensions of the webbed flooring when stretched substantially correspond to the dimensions of the area to be floored, the webbed floor having ends along an outer periphery thereof;

securing the ends of the webbed floor to at least one rigid bar in fixed relation thereto;

stretching the webbed flooring to the dimensions of the area to be floored by applying tension to the at least one rigid bar; and securing the at least one rigid bar to the frame in fixed relation thereto.

11. The method according to claim 10 wherein the webbing material is nylon webbing.

12. The method according to claim 10 wherein the webbed flooring comprises weaved webbing.

13. The method according to claim 12 wherein the weaved webbing is sewed together at areas of overlapping webbing.

14. The method according to claim 1 wherein:

the frame comprises a plurality of sides;

the webbed flooring comprises a plurality of sides corresponding to the sides of the rigid frame and loops at ends of the webbing material;

the step of sketching the webbed flooring to the dimensions of the area to be floored comprises the steps of:

positioning a rigid bar through the loops on each side of the webbed flooring, and applying tension to each bar for stretching the webbed flooring to the dimensions of the area to be floored; and the step of securing the webbed flooring to the frame comprises attaching each rigid bar in fixed relation thereto.

15. The method according to claim 14 wherein the step of securing the webbed flooring to the frame comprises attaching at least one band securing the frame to the rigid bar.

16. The method according to claim 14 wherein the step of applying tension to each rigid bars comprises operating a screw-actuated clamping member.

* * * * *

UNITED STATES PATENT AND TRADEMARK OFFICE

CERTIFICATE OF CORRECTION

PATENT NO. : 5,795,267

DATED : August 18, 1998

INVENTOR(S) : Darrell A. Weaver

It is certified that error appears in the above-identified patent and that said Letters Patent is hereby corrected as shown below:

Column 5, Line 31: delete: "dimensions" Insert: --dimensions,--

Column 6, Line 22: delete: "sketching" Insert: -- stretching--

Signed and Sealed this

Tenth Day of November 1998

*Attest:*

BRUCE LEHMAN

*Attesting Officer*

*Commissioner of Patents and Trademarks*